US006454113B1

(12) United States Patent
Schütz

(10) Patent No.: US 6,454,113 B1
(45) Date of Patent: Sep. 24, 2002

(54) TRANSPORT AND STORAGE CONTAINER FOR LIQUIDS AND METHOD FOR MANUFACTURING THE INNER CONTAINER OF THE TRANSPORT AND STORAGE CONTAINER

(75) Inventor: Udo Schütz, Selters-Westerwald (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 09/713,523

(22) Filed: Nov. 15, 2000

(30) Foreign Application Priority Data

Nov. 27, 1999 (DE) ..... 199 57 215

(51) Int. Cl.[7] ..... B65D 90/04

(52) U.S. Cl. ..... 220/1.6; 220/9.4; 220/495.06; 220/293

(58) Field of Search ..... 220/1.6, 62.19, 220/9.4, 495.06, 293

(56) References Cited

U.S. PATENT DOCUMENTS 4,785,956 A * 11/1988 Kepler et al. ..... 220/62.19
4,817,824 A * 4/1989 LaFleur et al. ..... 220/1.6
5,018,877 A 5/1991 Kantz
5,628,425 A * 5/1997 Sharp ..... 220/62.19
5,680,955 A * 10/1997 Schutz ..... 220/1.5
5,971,185 A * 10/1999 Schutz ..... 220/1.6
5,979,685 A * 11/1999 Schutz ..... 220/1.6
6,036,046 A * 3/2000 Brambach ..... 220/62.19

FOREIGN PATENT DOCUMENTS

| | | |
|---|---|---|
| DE | 3440367 | 5/1986 |
| DE | 3818721 | 1/1993 |
| DE | 197 22 194 C2 | 3/1999 |
| WO | 8907560 | 8/1989 |

* cited by examiner

*Primary Examiner*—Joseph M. Moy
(74) *Attorney, Agent, or Firm*—Friedrich Kueffner

(57) ABSTRACT

A transport and storage container for liquids has a pallet underframe to be handled by various transport devices. A parallelepipedal or cubic inner container of plastic material with a closeable fill and outlet opening or a closeable fill and removal opening is provided. A metal cage rests against the inner container and is formed of crossing horizontal and vertical cage rods of metal. The flexible inner container has an inner envelope of a plastic foil and an outer envelope of a woven material. The inner container is fastened to at least one of an upper frame of the metal cage and a protective cover of the metal cage. The inner envelope is positioned in the outer envelope of the inner container.

6 Claims, 5 Drawing Sheets

Fig. 2
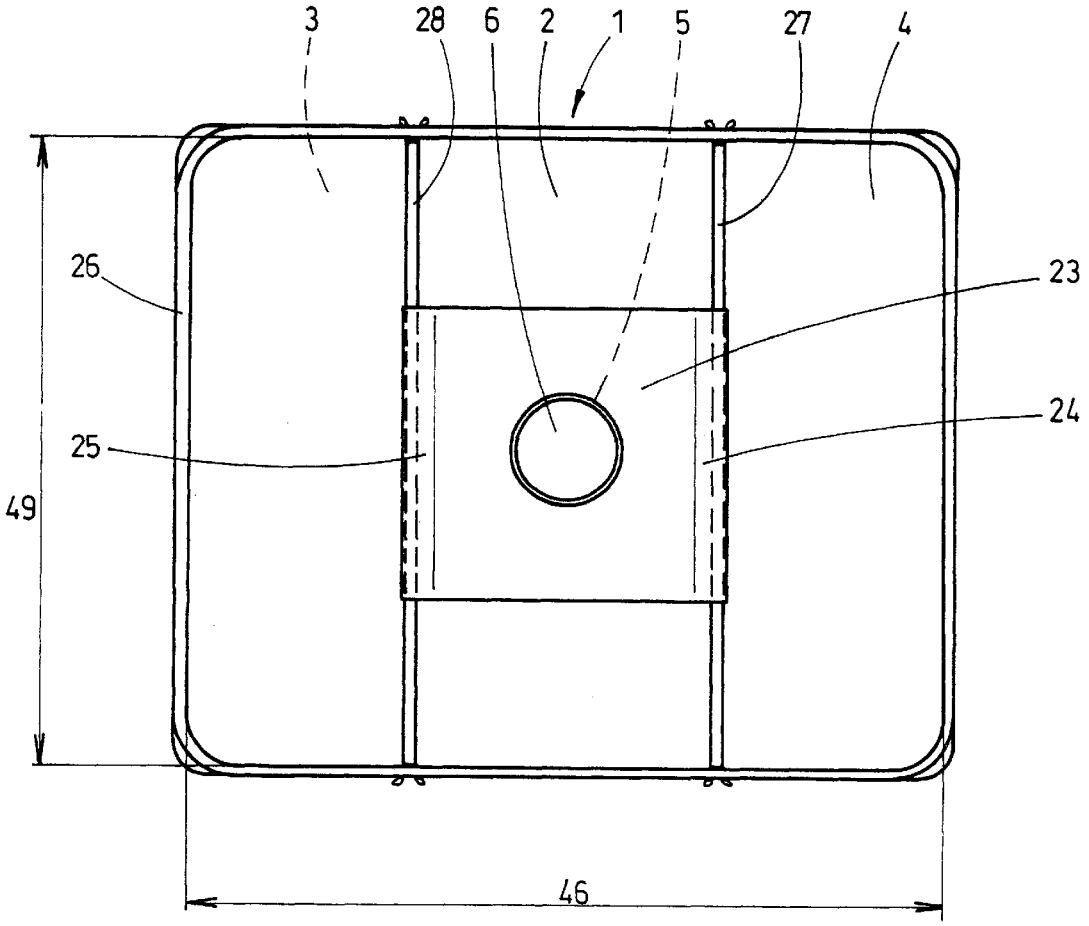
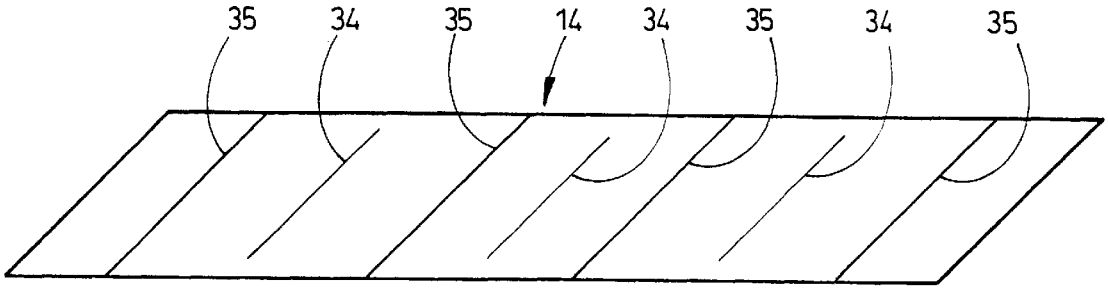
Fig. 3

Fig. 7
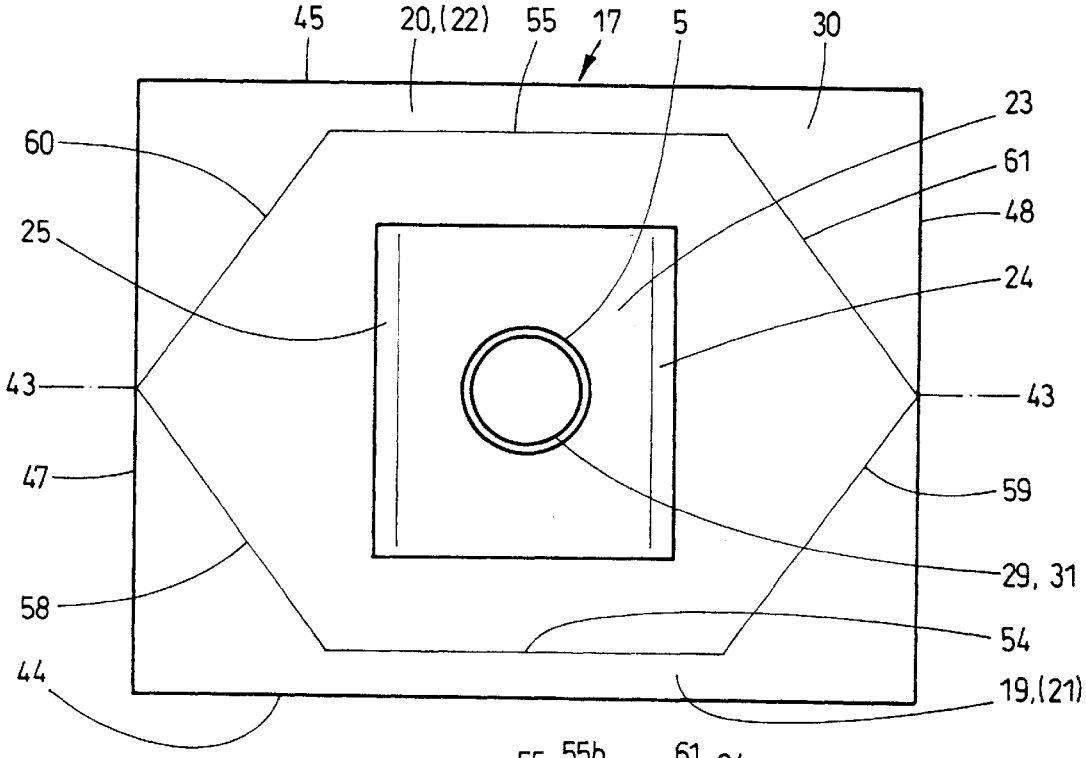
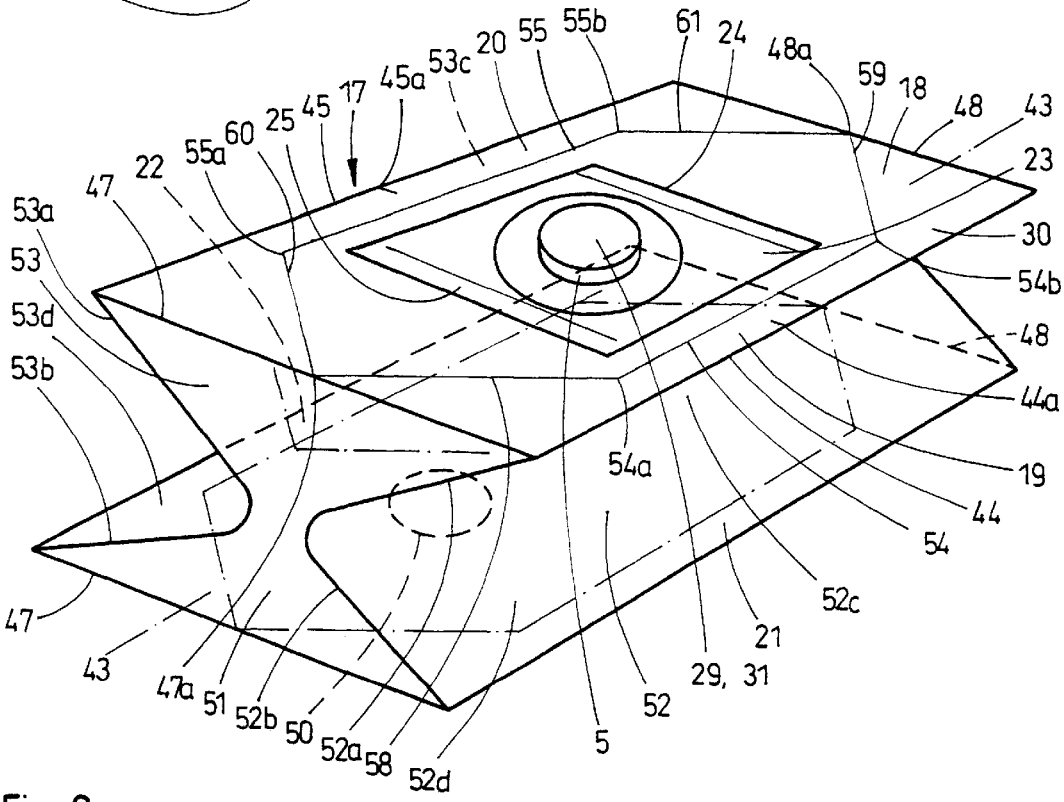
Fig. 8

TRANSPORT AND STORAGE CONTAINER FOR LIQUIDS AND METHOD FOR MANUFACTURING THE INNER CONTAINER OF THE TRANSPORT AND STORAGE CONTAINER

BACKGROUND OF THE INVENTION

1. Field of the Invention

The invention relates to a transport and storage container for liquids, comprising a pallet-like underframe which is designed for handling by means of a stacker truck, shelf servicing device or like transport means, comprising a parallelepipedal or cubicle inner container of plastic with a closeable fill and outlet opening or a closeable fill and removal opening, and a metal cage resting against the inner container and comprised of crossing horizontal and vertical cage rods of metal.

The invention also relates to a method for manufacturing the inner container of the transport and storage container described above.

2. Description of the Related Art

From German patent DE 197 22 194 C2 transport and storage containers of the aforementioned kind are known which have a blow-molded inner container of plastic material and are used for storing and for transporting liquid goods of all kinds in the chemical, pharmaceutical, petroleum, and foodstuff industries.

The stringent environmental laws and regulations require the transition from single use containers such as pallet containers and barrels for the transport and storage of liquids of different kinds to multi-use containers, the conversion to containers of greater volume with the goal of reducing the residual amounts, and the development of new multi-use containers which, with respect to relief of the environment with regard to harmful substances, can be reconditioned and whose plastic components contaminated by the transported and stored liquid goods can be disposed of in an optimal way by a contaminant-reduced or even contaminant-free disposal method, for example, by combustion.

SUMMARY OF THE INVENTION

It is an object of the present invention to further develop the transport and storage container of the aforementioned kind with respect to economical reconditioning and an inexpensive manufacture as well as an optimal disposal of the plastic inner container.

In accordance with the present invention, this is achieved in regard to the transport and storage container in that the flexible inner container is comprised of an inner envelope of a plastic foil and an outer envelope of a woven material, in that the inner container is fastened to the upper frame of the cage and/or a protective cover (cover rods) of the transport container, and in that the inner envelope is positioned in the outer envelope of the inner container.

In accordance with the present invention, this is furthermore achieved in regard to the method of manufacture by the steps of:

1. Cutting the tailored mantle piece for the outer envelope of the inner container from a woven web on a cutting table and transferring the axis markings and edge markings for the parallelepipedal or cubic mantle of the outer envelope to be produced by sewing from the cutting table onto the tailored mantle piece for proper positioning of the mantle, the tailored bottom piece, and the tailored cover piece of the outer envelope for a later sewing or gluing to the inner envelope;

2. Sewing the abutting edges of the tailored mantle piece on the left-hand side of the woven material to form the mantle of the outer envelope;
3. Cutting a tailored cover piece from a woven web for the outer envelope of the inner container with rounded corners and an opening for insertion of the fill socket of the inner container on a cutting table and transferring the axis markings from the cutting table onto the tailored cover piece;
4. Sewing securing straps at predetermined locations onto the tailored cover piece;
5. Cutting a tailored bottom piece from a woven web for the outer envelope of the inner container with rounded corners on a cutting table and transferring the axis markings from the cutting table onto the tailored bottom piece;
6. Cutting a tailored piece for the inner envelope of the inner container of a hose of foil material having lateral folds folded to the longitudinal center axis on a cutting table, wherein the longitudinal edges of the tailored piece have approximately twice the length of the length of the inner container to be manufactured and the transverse edges of the tailored piece are greater by a certain amount than the width of the inner container;
7. Cutting the openings for insertion of the fill socket and the outlet socket out of the upper and the lower foil web, respectively, of the tailored piece of the inner envelope;
8. Contour welding of the inner envelope of the inner container, wherein, for a tailored piece of a hose of a single layer foil material having lateral folds, in a first welding cycle the stacked and aligned transverse edges with the intermediately positioned edges of the folds of the folded tailored piece are welded; longitudinal edge strips are formed at the longitudinal edges of the upper foil web of the tailored piece by welding the upper foil web and the upper portion of the corresponding fold positioned underneath by means of a longitudinal welding seam, which longitudinal edge strips extend symmetrically to the center of the two longitudinal edges of the tailored piece; and, from the two ends of the longitudinal welding seams, receptively, slanted welding seams are placed that extend through the upper foil web and the upper portion positioned underneath of the corresponding fold to the center of the transverse edges of the tailored piece for separating off corresponding portions of the upper foil web and the folds of the tailored piece; and wherein in a second welding cycle the same contour welding of the lower foil web of the tailored piece and the lower portions of the folds adjoining the lower foil web is performed for forming lower longitudinal edge strips, with the exception of the welding of the transverse edges of the tailored piece already carried out in the first welding cycle;
9. Contour welding of the inner envelope of the inner container, whose tailored piece is comprised of a multi-layer foil, in particular, a two-layer foil of a weldable foil material, such as polyethylene, and a non-weldable foil material, such as polyamide, in a welding cycle according to method step 8;
10. Attaching by welding a tailored piece of foil material, having two edges formed as fastening loops and a fill socket attached by welding, onto the upper foil web of the contour-welded tailored piece of the inner envelope of the inner container, wherein the fill socket is welded to the edge area of the fill opening;
11. Attaching by welding the outlet socket with the edge area of the outlet opening in the lower foil web of the contour-welded tailored piece of the inner envelope of the inner container;

12. Folding the contour-welded inner envelope of the inner container onto the container footprint dimensions, wherein the welded longitudinal edge strips are positioned flush with one another;
13. Left-hand sided sewing or gluing of the welded upper longitudinal edge strips of the folded inner envelope to the tailored cover piece of the outer envelope;
14. Left-hand sided sewing or gluing of the welded longitudinal edge strips of the folded inner envelope to the tailored bottom piece of the outer envelope;
15. Unfolding the inner envelope and sewing or gluing the tailored mantle piece of the outer envelope about the periphery to the tailored bottom piece of the outer envelope and the lower longitudinal edge strips of the inner envelope as well as to the tailored cover piece of the outer envelope and the upper longitudinal edge portions of the inner envelope.

The transport and storage container for liquids according to the invention and the method for manufacturing the plastic inner container of the transport container have the following advantages.

The configuration of the inner container as a flexible container, which is comprised of an inner envelope of plastic foil and an outer envelope of a woven material, makes it possible, in comparison to liquid containers with an inner container blow-molded of plastic material, to reduce the tare weight and the transport costs due to the reduced thickness of the foil and woven material and a considerable reduction of the plastic material which is contaminated by paints, lacquers, and similarly environmentally harmful liquids so that the disposal of this plastic material is not problematic. The transport container can be reconditioned by a simple exchange of the inexpensive inner container at the manufacturing and filling facilities for liquid goods in an inexpensive way wherein the minimal space requirement of the flexible inner container as a result of its foldability and the lower manufacturing costs of the inner container provide inexpensive stock holding. Finally, the manufacture of the flexible inner container of a plastic foil and a woven material, preferably of plastic material, is more cost-efficient than the manufacture of the blow-molded plastic inner container in expensive blow-molding machines which require high investments.

BRIEF DESCRIPTION OF THE DRAWING

In the drawing:

FIG. 2 is a plan view onto the transport container according to FIG. 1;

FIG. 3 is a perspective illustration of the tailored mantle piece of the outer envelope of the inner container of the transport container;

FIG. 7 is a plan view of the tailored inner envelope of the inner container with the arrangement of the welding seams in the upper foil web of the tailored piece during contour welding of the inner envelope;

FIG. 8 is a perspective illustration of the slightly unfolded tailored inner envelope for illustrating the guiding of the welding seams during contour welding of the inner envelope.

DESCRIPTION OF THE PREFERRED EMBODIMENTS

Figure 1:
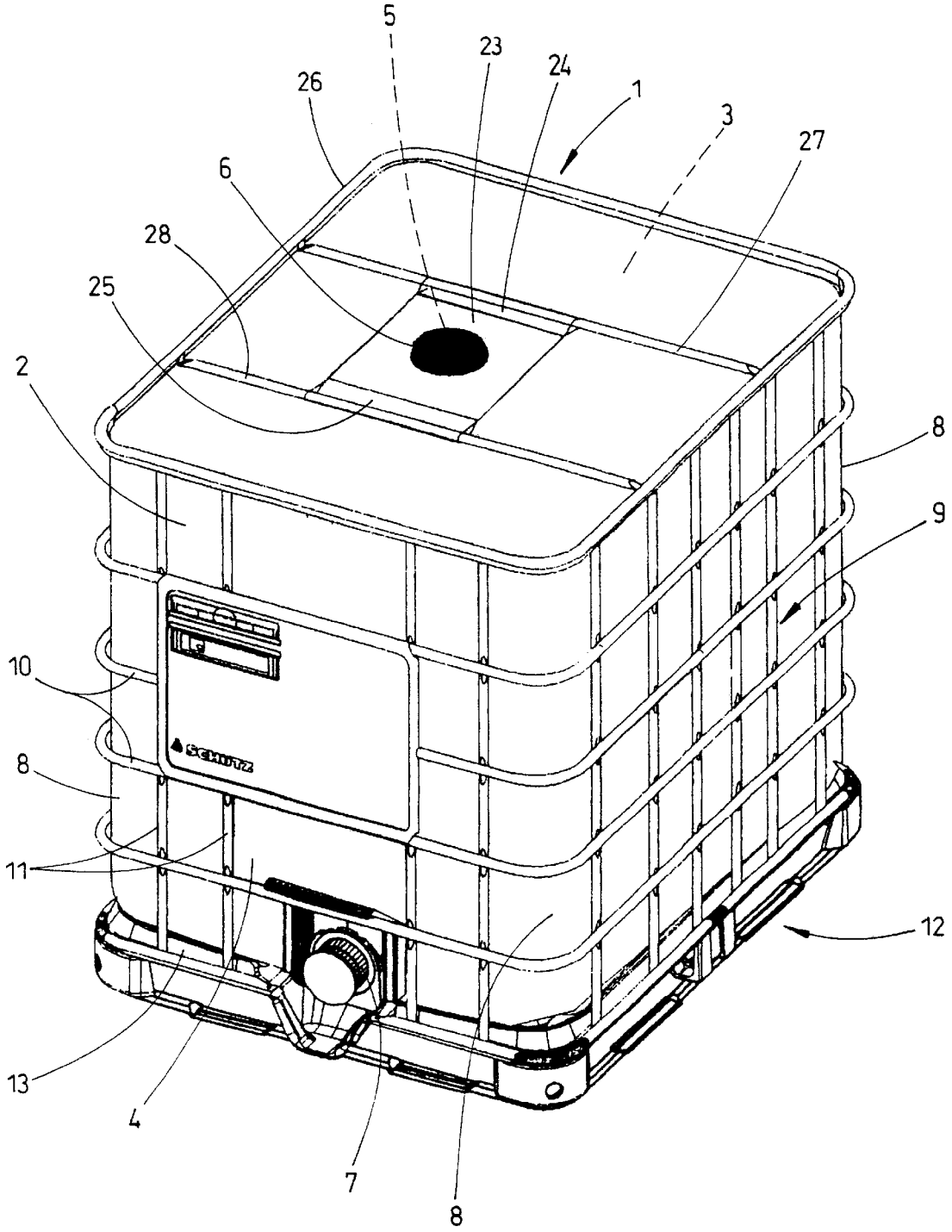
FIG. 1 is a perspective illustration of a transport and storage container.

Shown in FIGS. 1 and 2 is a transport and storage container 1 for liquid used as a single-use or multi-use container. It has as main components an inner container 2, which is exchangeable, flexible, and of a parallelepipedal shape with rounded corners 8, an inner envelope 3 made of a plastic foil material, for example, a polyethylene foil, and an outer envelope 4 of a woven material, for example, made of a polyamide fiber, for reinforcing the inner envelope 3. The container 1 is provided with a fill socket 5 to be closed by a screw lid 6 and an outlet socket 7 configured to connect a removal faucet or fixture thereto. Furthermore, a cage 9 of crossing horizontal and vertical cage rods 10, 11 of metal is provided as well as a pallet-like underframe 12 with longitudinal and width dimensions meeting European "Euronorm" standards. The underframe 12 is configured to be handled by means of stacker trucks, shelf servicing devices or the like and has a flat bottom tub 13 for a positive-locking reception of the inner container 2 filled with a liquid.

Figure 4:
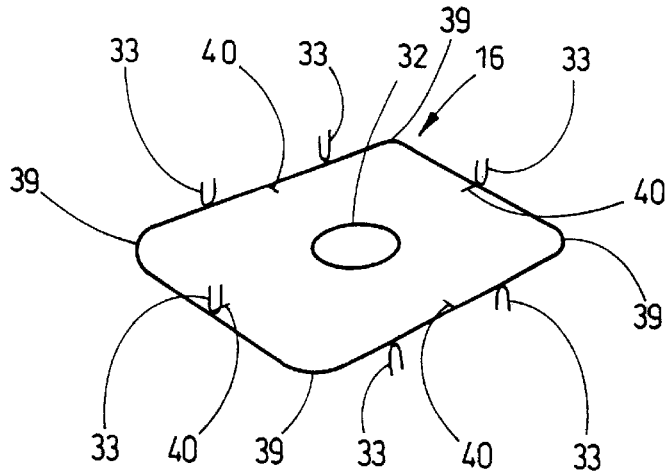
FIG. 4 is a perspective illustration of the tailored cover piece of the outer envelope of the inner container of the transport container.
Figure 5:
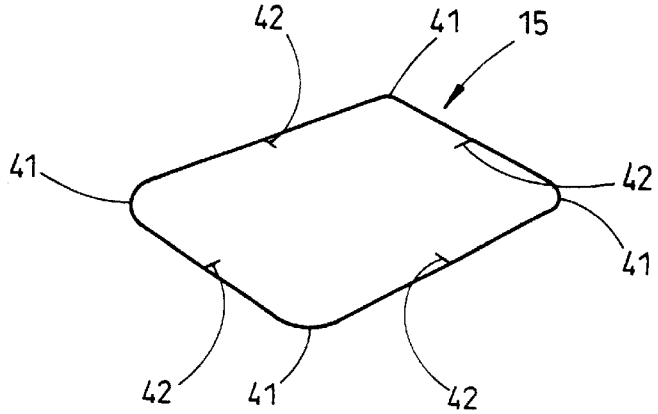
FIG. 5 is a perspective illustration of the tailored bottom piece of the outer envelope of the inner container of the transport container.

The outer envelope 4 of the inner container 2 is comprised of tailored mantle, bottom, and cover pieces 14, 15, 16 (FIGS. 3–5). The closed inner envelope 3, which is contour-welded of a tailored piece 17 cut from a hose 18 of plastic foil material having lateral folds, is sewn or glued with the welded longitudinal edge strips 19, 20, 21, 22 to the tailored mantle, bottom, and cover pieces 14, 15, 16 of the outer envelope 4 to form the inner container 2 and, in this way, is positioned in the outer envelope 4 (FIGS. 4–9).

A tailored piece 23, having edges formed as loops 24, 25 for suspending the inner container 2 from cover rods 27, 28 forming a protective cover for the inner container 2 and fastened to the upper frame 26 of the cage 9 of the transport container 1, is welded onto the tailored piece 17 of the inner envelope 3 of the inner container 2 (FIGS. 1, 2, 7, 8).

The tailored piece 23 with the suspending loops 24, 25 has a central opening 29 which is arranged congruently to a central opening 31 in the upper foil web 30 of the tailored piece 17 of the inner envelope 3 of the inner container 2, wherein the two openings 29, 31 are through openings for the fill socket 5 welded to the tailored piece 23 and the inner envelope 3 of the inner container 2.

In the tailored cover piece 16 of the outer envelope 4 of the inner container 2 a further through opening 32 for the fill socket 5 is arranged. Moreover, securing straps 33 for attachment of the inner container 2 on the upper frame 26 of the cage 9 are sewn to the tailored cover piece 16.

Figure 6:
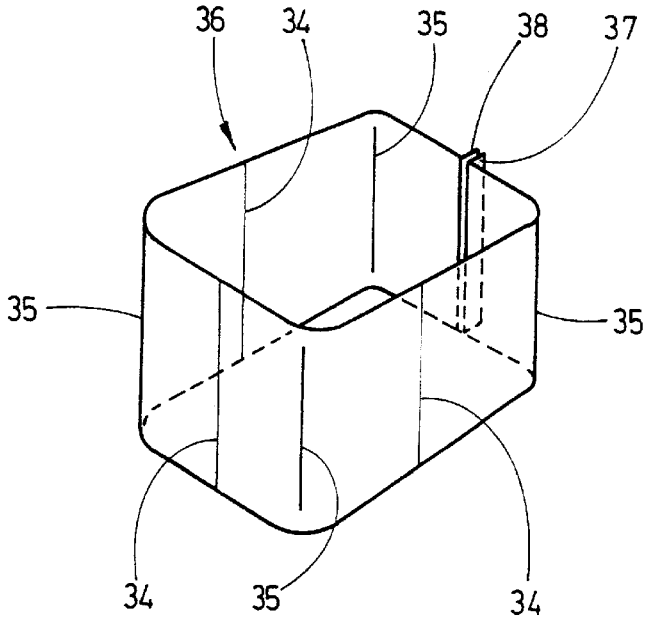
FIG. 6 is a perspective illustration of the mantle of the outer envelope sewn from the tailored mantle piece.
Figure 9:
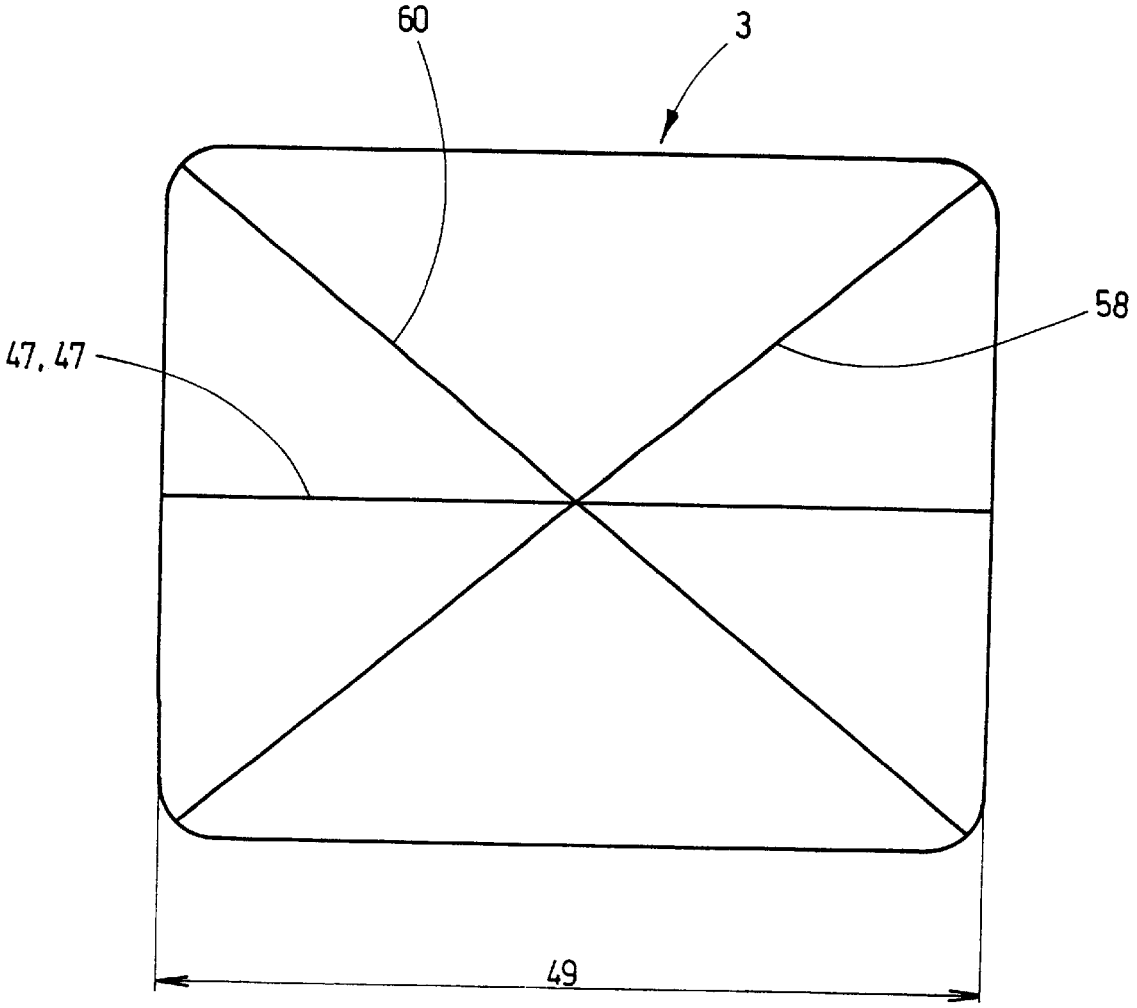
FIG. 9 is an end view of the unfolded inner envelope filled with a liquid for testing liquid tightness.

The method according to the invention for manufacturing the flexible inner container for the described transport and storage container for liquids is characterized by the following method steps:

1. Cutting a tailored mantle piece 14 for the outer envelope 4 of the inner container 2 from a woven web on a cutting table and transferring the axis markings 34 and edge markings 35 for the parallelepipedal or cubic mantle 36 of the outer envelope 4 to be produced by sewing from the cutting table onto the tailored mantle piece 14 for proper positioning of the mantle 36, the tailored bottom piece 15, and the tailored cover piece 16 of the outer envelope 4 for a later sewing or gluing to the inner envelope 3 (FIGS. 3 and 6);
2. Sewing the abutting edges 37, 38 of the tailored mantle piece 14 on the left-hand side of the woven material to form the mantle 36 of the outer envelope 4 (FIG. 6);

3. Cutting a tailored cover piece 16 from a woven web for the outer envelope 4 of the inner container 2 with rounded corners 39 and an opening 32 for insertion of the fill socket 5 of the inner container 2 on a cutting table and transferring the axis markings 40 from the cutting table onto the tailored cover piece 16 (FIG. 4);
4. Sewing securing straps 33 at predetermined locations onto the tailored cover piece 16;
5. Cutting a tailored bottom piece 15 from a woven web for the outer envelope 4 of the inner container 2 with rounded corners 41 on a cutting table and transferring the axis markings 42 from the cutting table onto the tailored bottom piece 15 (FIG. 5);
6. Cutting a tailored piece 17 for the inner envelope 3 of the inner container 2 of a hose 18 of foil material having lateral folds folded to the longitudinal center axis 43—43 on a cutting table, wherein the longitudinal edges 44, 45 of the tailored piece 17 have approximately twice the length of the length 46 of the inner container 2 to be manufactured and the transverse edges 47, 48 of the tailored piece 17 are greater by a certain amount than the width 49 of the inner container 2 (FIGS. 2, 7, 9);
7. Cutting the openings 31, 50 for insertion of the fill socket 5 and the outlet socket 7 out of the upper and the lower foil web 30, 51, respectively, of the tailored piece 17 of the inner envelope 3 (FIGS. 7 and 8);
8. Contour welding of the inner envelope 3 of the inner container 2, wherein for a tailored piece 17 of a hose 18 of a single layer foil material having lateral folds, in a first welding cycle the stacked and aligned transverse edges 47, 47; 48, 48 with the intermediately positioned edges 52*a*, 52*b*; 53*a*, 53*b* of the folds 52, 53 of the folded tailored piece 17 are welded; longitudinal edge strips 19, 20 are formed at the longitudinal edges 44, 45 of the upper foil web 30 of the tailored piece 17 by welding the upper foil web 30 and the upper portion 52*c*, 53*c* of the corresponding fold 52, 53 positioned underneath by means of a longitudinal welding seam 54, 55, which longitudinal edge strips extend symmetrically to the center 44*a*, 45*a* of the two longitudinal edges 44, 45 of the tailored piece 17; and, from the two ends 54*a*, 54*b*; 55*a*, 55*b* of the longitudinal welding seams 54, 55, receptively, slanted welding seams 58–61 are placed that extend through the upper foil web 30 and the upper portion 52*c*, 53*c* positioned underneath of the corresponding fold 52, 53 to the center 47*a*, 48*a* of the transverse edges 47, 48 of the tailored piece 17 for separating off corresponding portions of the upper foil web 30 and the folds 52, 53 of the tailored piece 17; and wherein in a second welding cycle the same contour welding of the lower foil web 51 of the tailored piece 17 and the lower portions 52*d*, 53*d* of the folds 52, 53 adjoining the lower foil web 51 is performed for forming lower longitudinal edge strips 21, 22, with the exception of the welding of the transverse edges 47, 47; 48, 48 of the tailored piece 17 already carried out in the first welding cycle (FIGS. 7 and 8);
9. Contour welding of the inner envelope 3 of the inner container 2, whose tailored piece 17 is comprised of a multi-layer foil, in particular, a two-layer foil of a weldable foil material, such as polyethylene, and a non-weldable foil material, such as polyamide, in a welding cycle according to method step 8;
10. Attaching by welding a tailored piece 23 of foil material, having two edges formed as fastening loops 24, 25 and a fill socket 5 attached by welding, onto the upper foil web 30 of the contour-welded tailored piece 17 of the inner envelope 3 of the inner container 2, wherein the fill socket 5 is welded to the edge area of the fill opening 31 (FIGS. 7 and 8);
11. Attaching by welding the outlet socket 7 with the edge area of the outlet opening 50 in the lower foil web 51 of the contour-welded tailored piece 17 of the inner envelope 3 of the inner container 2;
12. Folding the contour-welded inner envelope 3 of the inner container 2 onto the container footprint dimensions, wherein the welded longitudinal edge strips 19, 20; 21, 22 are positioned flush with one another;
13. Left-hand sided sewing or gluing of the welded upper longitudinal edge strips 19, 20 of the folded inner envelope 3 to the tailored cover piece 16 of the outer envelope 4;
14. Left-hand sided sewing or gluing the welded longitudinal edge strips 21, 22 of the folded inner envelope 3 to the tailored bottom piece 15 of the outer envelope 4;
15. Left-hand sided sewing or gluing the tailored mantle piece 14 of the outer envelope 4 about the periphery to its tailored bottom piece 15 and the lower longitudinal edge strips 21, 22 of the inner envelope 3;
16. Pulling the tailored mantle portion 14 together with the inner envelope 3 and the tailored bottom portion 15 to the right side; and
17. Peripherally sewing or gluing the tailored mantle portion 14, turned out to the right side, of the outer envelope 4 about the periphery to the tailored cover piece 16 of the outer envelope 4 and the upper longitudinal edge strips 19, 20 of the inner envelope 3.

By turning inside out (turning to the right side) the tailored mantle piece 14 of the outer envelope 4, the sewn-together abutting edges 37, 38 of the tailored mantle portion 14 are moved to the inner side so that the outer appearance of the inner container 2 is not impaired.

However, turning the tailored mantle piece 14 of the outer envelope 4 inside out after method step 15 can also be omitted. In this case, subsequent to the method step 14, the inner envelope 3 is unfolded and then the tailored mantle portion 14 is sewn or glued peripherally to the tailored bottom piece 15 of the outer envelope 4 and the lower longitudinal edge strips 21, 22 of the inner envelope 3 as well as to the tailored cover piece 16 of the outer envelope 4 and the upper longitudinal edge strips 19, 20 of inner envelope 3.

While specific embodiments of the invention have been shown and described in detail to illustrate the inventive principles, it will be understood that the invention may be embodied otherwise without departing from such principles.

What is claimed is:

1. A transport and storage container for liquids comprising:

a pallet-like under frame configured to be handled by various transport devices;

a parallelepipedal or cubic inner container of plastic material with a closeable fill and outlet opening or a closeable fill and removal opening;

a metal cage resting against the inner container and comprised of crossing horizontal and vertical cage rods of metal;

wherein the flexible inner container is comprised of an inner envelope of a plastic foil and an outer envelope of a woven material;

wherein the inner container is fastened to at least one of an upper frame of the metal cage and a protective cover of the metal cage;

wherein the inner envelope is positioned in the outer envelope of the inner container;

wherein the outer envelope of the inner container is comprised of a tailored mantle piece, a tailored bottom piece, and a tailored cover piece;

wherein the closed inner envelope is formed of a contour-welded tailored piece of a hose of plastic material having lateral folds and comprises longitudinal and transverse edge strips; and wherein the inner envelope is sewn or glued with at least one of the longitudinal and transverse edge strips to the tailored mantle, bottom, and cover pieces of the outer envelope to form the inner container.

2. The container according to claim 1, comprising a tailored piece, having edges formed as suspending loops for suspending the inner container from cover rods forming the protective cover and connected to the upper frame of the metal cage, being welded onto the tailored piece of the inner envelope of the inner container.

3. The container according to claim 2, wherein the inner container has a filling socket with a closure lid and wherein the tailored piece with the suspending loops has a central opening which is congruent to a central opening in an upper foil web of the tailored piece of the inner envelope, wherein the central openings are through openings configured to receive the filling socket with the closure lid, wherein the filling socket with the closure lid is welded to the tailored piece with the suspending loops and to the inner envelope.

4. The container according to claim 3, wherein the cover piece of the outer envelope has a through opening for the fill socket and further has securing strips sewn onto the cover piece and configured to attach the inner container to the upper frame of the metal cage.

5. A method for manufacturing a flexible inner container for transport and storage containers according to claim 1, comprising the following method steps:

1.) cutting the tailored mantle piece for the outer envelope of the inner container from a woven web on a cutting table and transferring the axis markings and edge markings for the parallelepipedal or cubic mantle of the outer envelope to be produced by sewing from the cutting table onto the tailored mantle piece for proper positioning of the mantle, the tailored bottom piece, and the tailored cover piece of the outer envelope for a later sewing or gluing to the inner envelope;

2.) sewing the abutting edges of the tailored mantle piece on the left-hand side of the woven material to form the mantle of the outer envelope;

3.) cutting a tailored cover piece from a woven web for the outer envelope of the inner container with rounded corners and an opening for insertion of the fill socket of the inner container on a cutting table and transferring the axis markings from the cutting table onto the tailored cover piece;

4.) sewing securing straps at predetermined locations onto the tailored cover piece;

5.) cutting a tailored bottom piece from a woven web for the outer envelope of the inner container with rounded corners on a cutting table and transferring the axis markings from the cutting table onto the tailored bottom piece;

6.) cutting a tailored piece for the inner envelope of the inner container of a hose of foil material having lateral folds folded to the longitudinal center axis on a cutting table, wherein the longitudinal edges of the tailored piece have approximately twice the length of the length of the inner container to be manufactured and the transverse edges of the tailored piece are greater by a certain amount than the width of the inner container;

7.) cutting the openings for insertion of the fill socket and the outlet socket out of the upper and the lower foil web, respectively, of the tailored piece of the inner envelope;

8.) contour welding of the inner envelope of the inner container, wherein, for a tailored piece of a hose of a single layer foil material having lateral folds, in a first welding cycle the stacked and aligned transverse edges with the intermediately positioned edges of the folds of the folded tailored piece are welded; longitudinal edge strips are formed at the longitudinal edges of the upper foil web of the tailored piece by welding the upper foil web and the upper portion of the corresponding fold positioned underneath by means of a longitudinal welding seam, which longitudinal edge strips extend symmetrically to the center of the two longitudinal edges of the tailored piece; and, from the two ends of the longitudinal welding seams, receptively, slanted welding seams are placed that extend through the upper foil web and the upper portion positioned underneath of the corresponding fold to the center of the transverse edges of the tailored piece for separating off corresponding portions of the upper foil web and the folds of the tailored piece; and wherein in a second welding cycle the same contour welding of the lower foil web of the tailored piece and the lower portions of the folds adjoining the lower foil web is performed for forming lower longitudinal edge strips, with the exception of the welding of the transverse edges of the tailored piece already carried out in the first welding cycle;

9.) contour welding of the inner envelope of the inner container, whose tailored piece is comprised of a multi-layer foil, in particular, a two-layer foil of a weldable foil material, such as polyethylene, and a non-weldable foil material, such as polyamide, in a welding cycle according to method step 8;

10.) attaching by welding a tailored piece of foil material, having two edges formed as fastening loops and a fill socket attached by welding, onto the upper foil web of the contour-welded tailored piece of the inner envelope of the inner container, wherein the fill socket is welded to the edge area of the fill opening;

11.) attaching by welding the outlet socket with the edge area of the outlet opening in the lower foil web of the contour-welded tailored piece of the inner envelope of the inner container;

12.) folding the contour-welded inner envelope of the inner container onto the container footprint dimensions, wherein the welded longitudinal edge strips are positioned flush with one another;

13.) left-hand sided sewing or gluing of the welded upper longitudinal edge strips of the folded inner envelope to the tailored cover piece of the outer envelope;

14.) left-hand sided sewing or gluing of the welded longitudinal edge strips of the folded inner envelope to the tailored bottom piece of the outer envelope;

15.) unfolding the inner envelope and sewing or gluing the tailored mantle piece of the outer envelope about the periphery to the tailored bottom piece and the lower longitudinal edge strips of the inner envelope as well as to the tailored cover piece of the outer envelope and the upper longitudinal edge portions of the inner envelope.

6. A method for manufacturing a flexible inner container for transport and storage containers according to claim 1, comprising the following method steps:

1.) cutting the tailored mantle piece for the outer envelope of the inner container from a woven web on a cutting table and transferring the axis markings and edge markings for the parallelepipedal or cubic mantle of the outer envelope to be produced by sewing from the cutting table onto the tailored mantle piece for proper positioning of the mantle, the tailored bottom piece, and the tailored cover piece of the outer envelope for a later sewing or gluing to the inner envelope;

2.) sewing the abutting edges of the tailored mantle piece on the left-hand side of the woven material to form the mantle of the outer envelope;

3.) cutting a tailored cover piece from a woven web for the outer envelope of the inner container with rounded corners and an opening for insertion of the fill socket of the inner container on a cutting table and transferring the axis markings from the cutting table onto the tailored cover piece;

4.) sewing securing straps at predetermined locations onto the tailored cover piece;

5.) cutting a tailored bottom piece from a woven web for the outer envelope of the inner container with rounded corners on a cutting table and transferring the axis markings from the cutting table onto the tailored bottom piece;

6.) cutting a tailored piece for the inner envelope of the inner container of a hose of foil material having lateral folds folded to the longitudinal center axis on a cutting table, wherein the longitudinal edges of the tailored piece have approximately twice the length of the length of the inner container to be manufactured and the transverse edges of the tailored piece are greater by a certain amount than the width of the inner container;

7.) c utting the openings for insertion of the fill socket and the outlet socket out of the upper and the lower foil web, respectively, of the tailored piece of the inner envelope;

8.) contour welding of the inner envelope of the inner container, wherein, for a tailored piece of a hose of a single layer foil material having lateral folds, in a first welding cycle the stacked and aligned transverse edges with the intermediately positioned edges of the folds of the folded tailored piece 17 are welded; longitudinal edge strips are formed at the longitudinal edges of the upper foil web of the tailored piece by welding the upper foil web and the upper portion of the corresponding fold positioned underneath by means of a longitudinal welding seam, which longitudinal edge strips extend symmetrically to the center of the two longitudinal edges of the tailored piece; and, from the two ends of the longitudinal welding seams, receptively, slanted welding seams are placed that extend through the upper foil web and the upper portion positioned underneath of the corresponding fold to the center of the transverse edges of the tailored piece for separating off corresponding portions of the upper foil web and the folds of the tailored piece; and wherein in a second welding cycle the same contour welding of the lower foil web of the tailored piece and the lower portions of the folds adjoining the lower foil web is performed for forming lower longitudinal edge strips, with the exception of the welding of the transverse edges of the tailored piece already carried out in the first welding cycle;

9.) contour welding of the inner envelope of the inner container, whose tailored piece is comprised of a multilayer foil, in particular, a two-layer foil of a weldable foil material, such as polyethylene, and a non-weldable foil material, such as polyamide, in a welding cycle according to method step 8;

10.) attaching by welding a tailored piece of foil material, having two edges formed as fastening loops and a fill socket attached by welding, onto the upper foil web of the contour-welded tailored piece of the inner envelope of the inner container, wherein the fill socket is welded to the edge area of the fill opening;

11.) attaching by welding the outlet socket with the edge area of the outlet opening in the lower foil web of the contour-welded tailored piece of the inner envelope of the inner container;

12.) folding the contour-welded inner envelope of the inner container onto the container footprint dimensions, wherein the welded longitudinal edge strips are positioned flush with one another;

13.) left-hand sided sewing or gluing of the welded upper longitudinal edge strips of the folded inner envelope to the tailored cover piece of the outer envelope;

14.) left-hand sided sewing or gluing of the welded longitudinal edge strips of the folded inner envelope to the tailored bottom piece of the outer envelope;

15.) left-hand sided sewing or gluing of the tailored mantle piece of the outer envelope peripherally to the tailored bottom piece of the outer envelope and the lower longitudinal edge strips of the inner envelope;

16). Pulling the tailored mantle piece together with the inner envelope and the tailored bottom portion to the right side; and 17.) peripherally sewing or gluing of the tailored mantle portion, turned out to the right side, of the outer envelope about the periphery to the tailored cover piece of the outer envelope and the upper longitudinal edge strips of the inner envelope.

* * * * *